US008545242B2

(12) United States Patent
Zhang et al.

(10) Patent No.: US 8,545,242 B2
(45) Date of Patent: Oct. 1, 2013

(54) DUSTPROOF ELECTRICAL CONNECTOR ASSEMBLY

(75) Inventors: Han-Ming Zhang, Shenzhen (CN); Jian-Xin Jiang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/445,824

(22) Filed: Apr. 12, 2012

(65) Prior Publication Data

US 2012/0264313 A1 Oct. 18, 2012

(51) Int. Cl.
*H01R 13/44* (2006.01)

(52) U.S. Cl.
USPC ..... 439/131

(58) Field of Classification Search
USPC ..... 439/157, 159, 138, 142, 131, 372, 439/304
See application file for complete search history.

(56) References Cited

U.S. PATENT DOCUMENTS 4,940,414 A * 7/1990 Lee ..... 439/131
6,527,566 B1 * 3/2003 Lambiaso ..... 439/131
7,787,243 B2 * 8/2010 Salazar et al. ..... 361/679.31
7,811,102 B2 * 10/2010 Lai ..... 439/131
8,272,884 B2 * 9/2012 Lin et al. ..... 439/131
8,274,786 B2 * 9/2012 Sapper et al. ..... 361/679.4
8,292,641 B2 * 10/2012 Kim et al. ..... 439/135
8,325,239 B2 * 12/2012 Kaplan et al. ..... 348/207.1
8,351,189 B2 * 1/2013 Yang et al. ..... 361/679.01
2007/0066102 A1 * 3/2007 Takemoto et al. ..... 439/131
2008/0280466 A1 * 11/2008 Sitz et al. ..... 439/131
2009/0197443 A1 * 8/2009 Wei et al. ..... 439/131
2009/0197445 A1 * 8/2009 Kobayashi et al. ..... 439/153
2010/0264313 A1 * 10/2010 Jalbout et al. ..... 250/340
2012/0149219 A1 * 6/2012 Lin et al. ..... 439/131

* cited by examiner

*Primary Examiner* — Neil Abrams
*Assistant Examiner* — Phuongchi T Nguyen
(74) *Attorney, Agent, or Firm* — Ming Chieh Chang; Wei Te Chung

(57) ABSTRACT

An electrical connector assembly (100) includes an electrical connector (1), a cage (5) defining an opening (51), an ejection mechanism (3) assembled on an electrical device and receiving the electrical connector, and a flexible circuit board (2) connecting the electrical connector with a mother board of the electrical device for signal transmission. The ejection mechanism has a second housing (7) retractively movably relative to the first housing to extend through the opening of the cage. The electrical connector is received in the second housing such that the electrical connector is movable out of the electrical device for connecting with a mating connector and retractable in the electrical device when the electrical connector is not in use.

20 Claims, 6 Drawing Sheets

DUSTPROOF ELECTRICAL CONNECTOR ASSEMBLY

BACKGROUND OF THE INVENTION

1. Field of the Invention

The present invention relates generally to an electrical connector assembly, and more particularly to a dustproof electrical connector assembly.

2. Description of Related Arts

An electrical connector (such as an audio jack connector) assembled on an electronic device (such as a mobile phone), is usually exposed to outside via an opening defined on the electronic device for conveniently connecting with a mating connector (such as an audio plug connector). However, the electrical connector may be dusty when it is directly communicated with exterior of the electronic device. Accordingly, a plastic stopple is connected with the electronic device for enveloping the opening of the electronic device when the electrical connector is not in use. The plastic stopple is rotatable for giving way to the opening when the electrical connector is connected with the mating connector. However, material of the plastic stopple is inconsistent with that of periphery of the electronic device such that the electronic device is not aesthetically appealing.

Hence, an improved dustproof electrical connector assembly is desired.

SUMMARY OF THE INVENTION

Accordingly, an object of the present invention is to provide a dustproof and handsome electrical connector assembly.

To achieve the above object, an electrical connector assembly includes an electrical connector, a cage defining an opening, an ejection mechanism assembled on an electrical device and receiving the electrical connector, and a flexible circuit board connecting the electrical connector with a mother board of the electrical device for signal transmission. The ejection mechanism has a second housing retractively movably relative to the first housing to extend through the opening of the cage. The electrical connector is received in the second housing such that the electrical connector is movable out of the electrical device for connecting with a mating connector and retractable in the electrical device when the electrical connector is not in use.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-6, an electrical connector assembly 100 comprises an electrical connector 1, a container (not labeled) assembled on an electrical device (not shown) and receiving the electrical connector 1, and a flexible circuit board 2 connecting the electrical connector 1 with a mother board (not shown) of the electrical device for signal transmission. The container has a part (detailed described in the following) movable out of the electrical device such that the electrical connector 1 is capable of connecting with a mating connector (not shown) and retractable in the electrical device when the electrical connector 1 is not in use. The electrical connector 1 has an insertion hole 10 through which the mating connector is inserted.

Figure 1:
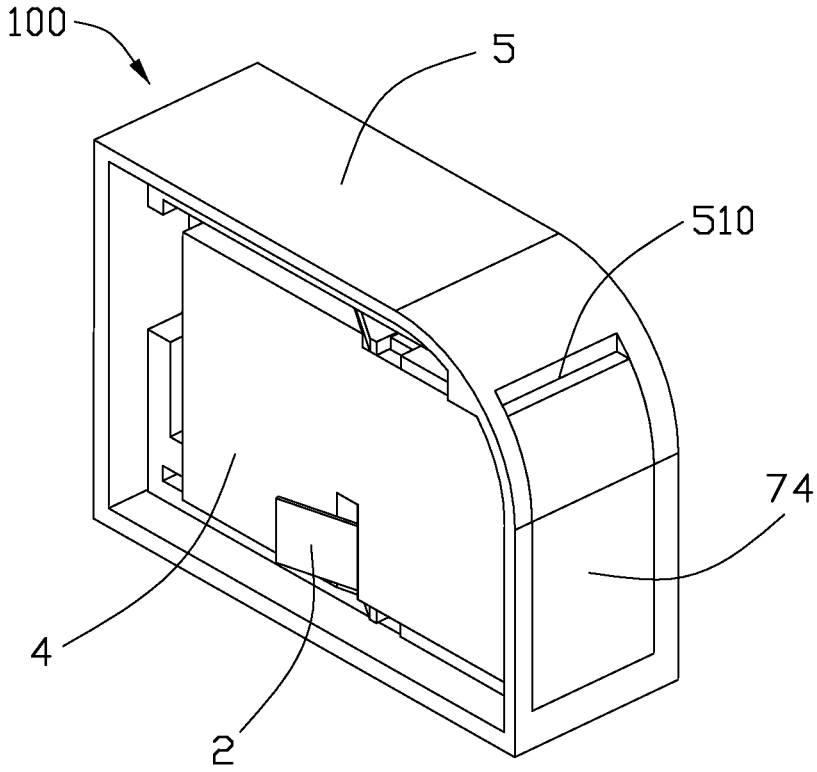
FIG. 1 is a perspective, assembled view of an electrical connector assembly constructed in accordance with the present invention.
Figure 2:
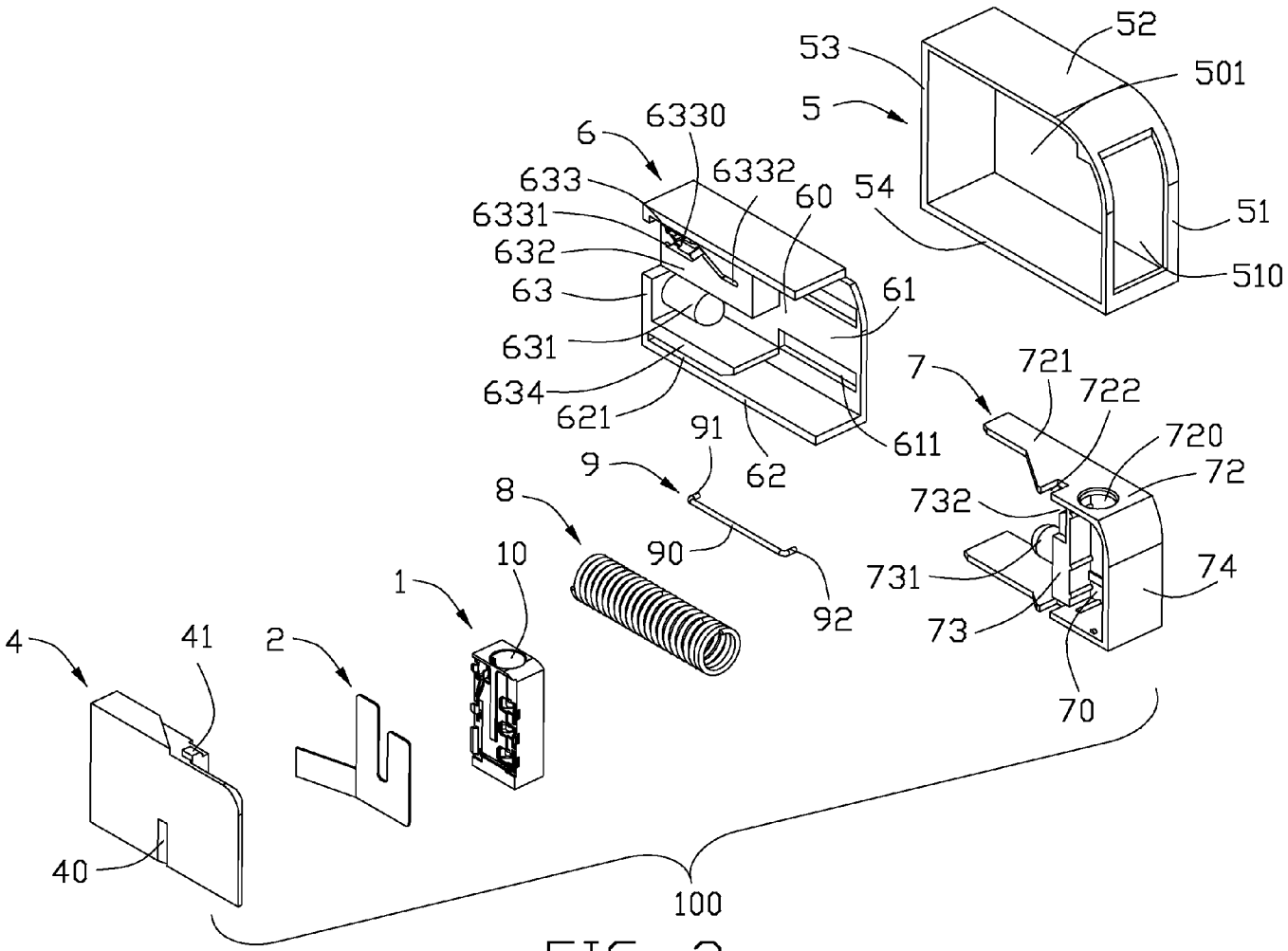
FIG. 2 is a first perspective, exploded view of the electrical connector assembly.
Figure 3:
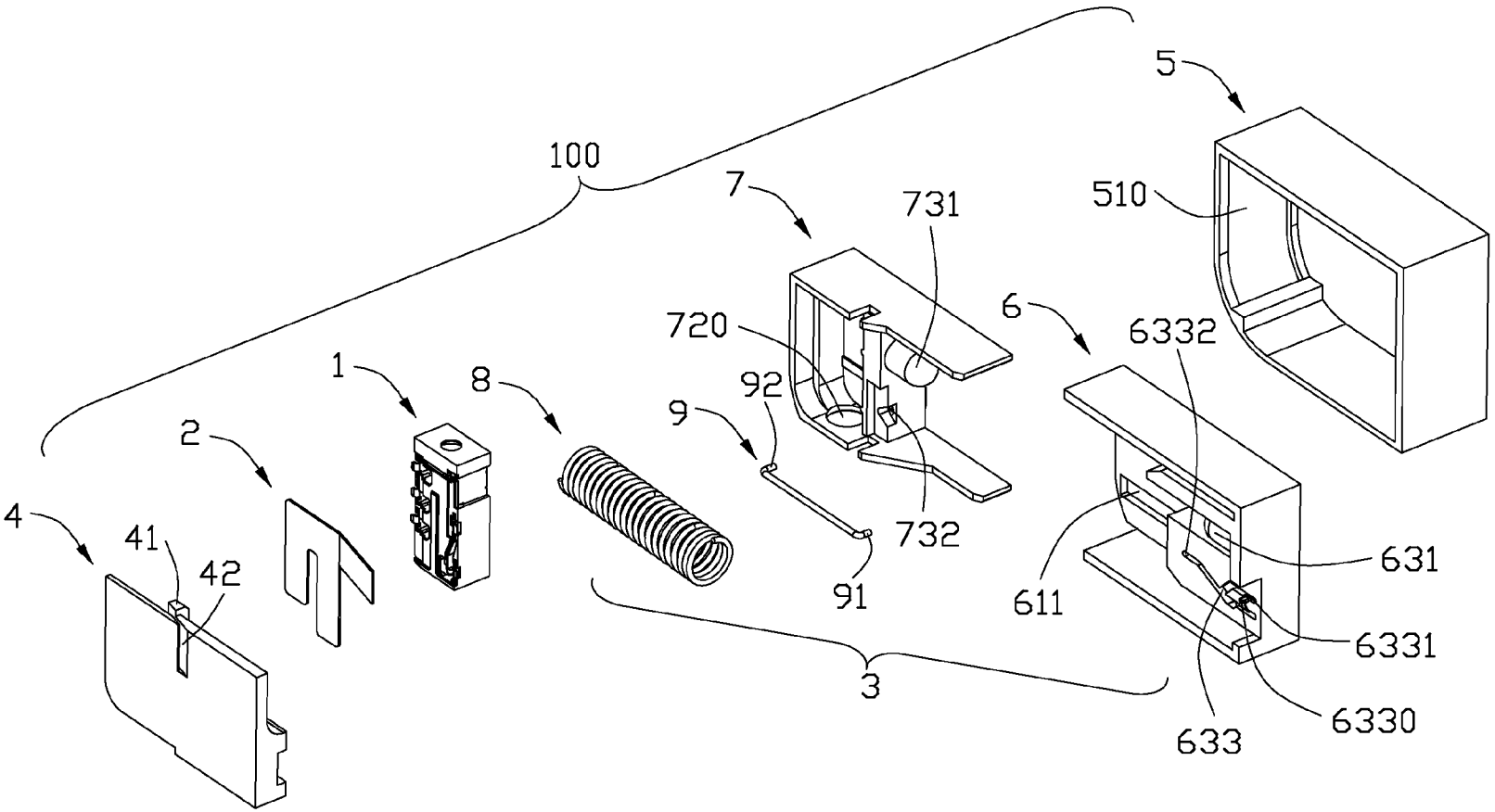
FIG. 3 is a second perspective, exploded view of the electrical connector assembly.
Figure 4:
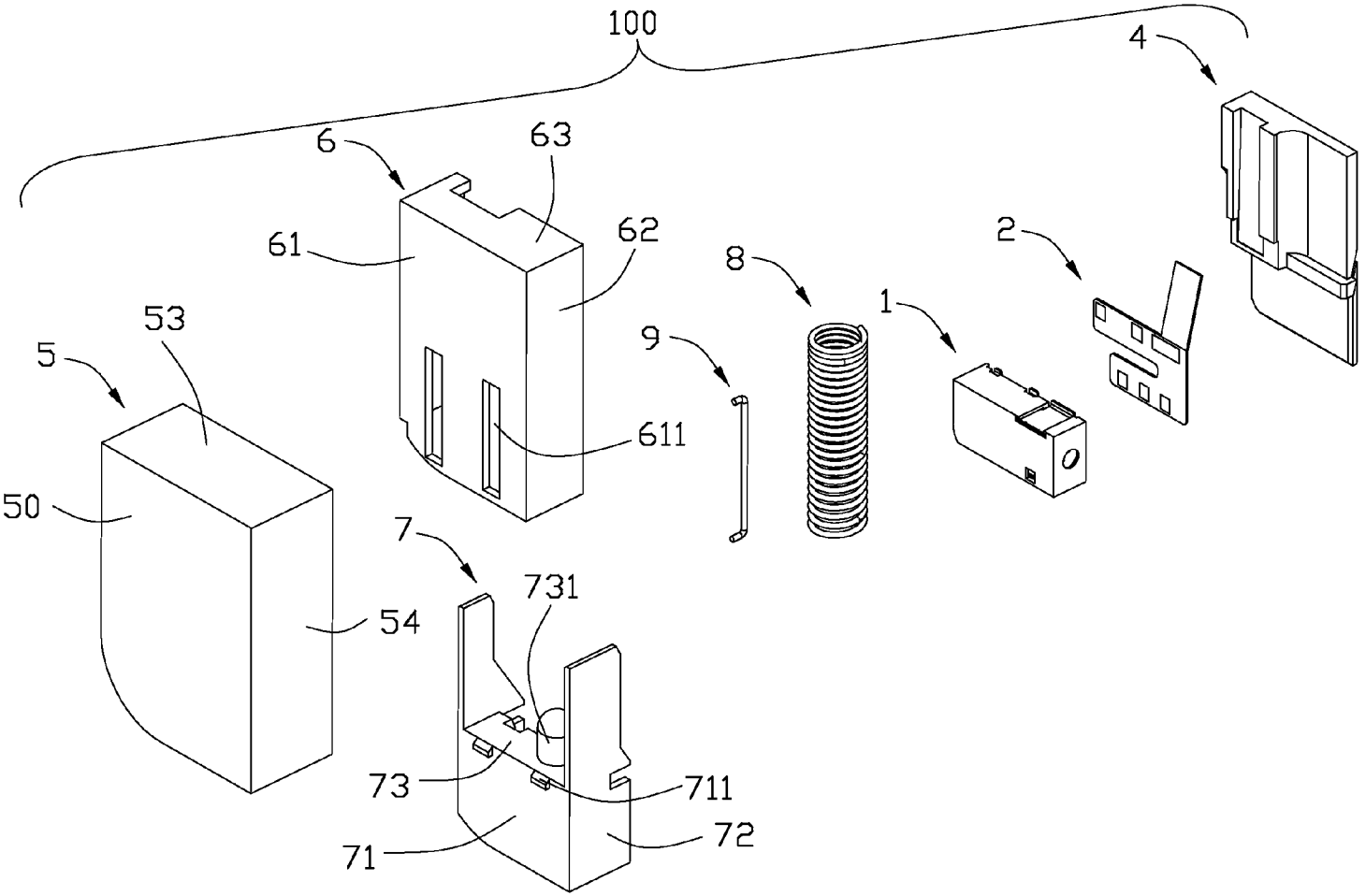
FIG. 4 is a third perspective, exploded view of the electrical connector assembly.

Referring to FIGS. 2-4, the container comprises a cage 5 (the cage 5 is a part of the electrical device) and an ejection mechanism 3 received in the cage 5. The cage 5 comprises a bottom plate 50 and a plurality of sidewalls 51-54 extending vertically from the bottom plate 50. The bottom plate 50 and the sidewalls 51-54 cooperatively define a receiving room 501 for holding the ejection mechanism 3. The four sidewalls 51-54 have three right-angled corners between a first sidewall 51 and a fourth sidewall 54, a second sidewall 52 and a third sidewall 53, the third sidewall 53 and the fourth sidewall 54, and an arced corner between the first sidewall 51 and the second sidewall 52. The first sidewall 51 keeps planar with periphery of the electrical device. The first sidewall 51 defines an opening 510 for communicating the receiving room 501 with exterior of the electrical device.

Referring to FIGS. 2-5, the ejection mechanism 3 comprises an immovable housing 6 held in the receiving space 501 of the cage 5, a movable housing 7 slidably assembled on the immovable housing 6 along a front-and-back direction, an elastic element 8 compressed between the immovable housing 6 and the movable housing 7, and a pin member 9 with a first end 92 thereof retained with the movable housing 7 and a second end 91 thereof moveably guided by the immovable housing 6.

Referring to FIGS. 2-5, the immovable housing 6 comprises a first bottom wall 61, an upper wall 62, a lower wall 62 and a rear wall 63 extending vertically from the first bottom wall 61. The first bottom wall 61, the upper wall 62, the lower wall 62, and the rear wall 63 cooperatively define a first space 60 with an opened, frond end for receiving the moveable housing 7. The first bottom wall 61 defines at least one slit 611 adjacent to the front end of the immovable housing 6. The immovable housing 6 forms a block portion 632, a barrier portion 634, and a first bar portion 631, all of the three extending forwardly from the rear wall 63 into the first space 60. The block portion 632 lies adjacent to the upper wall 62, the barrier portion 634 lies adjacent to the lower wall 62, and the bar portion 631 is located between the block portion 632 and the barrier portion 634. The block portion 632 defines a heart-shaped slot 633 on an outer surface thereof. Two elongated grooves 621 are defined between the upper wall 62 and the barrier portion 634 and between the lower wall 62 and the block portion 632.

Referring to FIGS. 2-5, the movable housing 7 comprises a second bottom wall 71, a pair of lateral walls 72, a front wall 74 extending vertically from the second bottom wall 71, and a transverse wall 73 connecting with the lateral walls 72 and facing towards the front wall 74. The second bottom wall 71, the lateral walls 72, the front wall 74, and the transverse wall 73 cooperatively define a second space 70 for receiving the electrical connector 1. The second bottom wall 71 forms at least one protrusion 711 correspondingly received in the at least one slit 611. The at least one protrusion 711 is moveable in the at least one slit 611 along the front-and-back direction. The lateral walls 72 extend from the front wall 74 and beyond the transverse wall 73. Therefore, the lateral walls 72 have a pair of wing portions 721 received in the elongated grooves 621 and guidably moving in the grooves 621. Each lateral wall 72 defines a notch 722. The movable housing 7 forms a second bar portion 731 from the transverse wall 73 and towards the immovable housing 6. Therefore, the elastic element 8 is oriented by the first bar portion 631 and the second bar portion 731 such that the elastic element 8 is positioned between the immovable housing 6 and the movable housing 7. The movable housing 7 defines a hole 732 on the transverse wall 73 which is beside the second bar portion 731 such that the first end 92 of the pin member 9 is retained in the hole 732 of the movable housing 7 and the second end 91 of the pin member 9 is moveably guided in the heart-shaped slot 633 of the immovable housing 6. The movable housing 7 defines an aperture 720 at one of the lateral walls 72.

Figure 5:
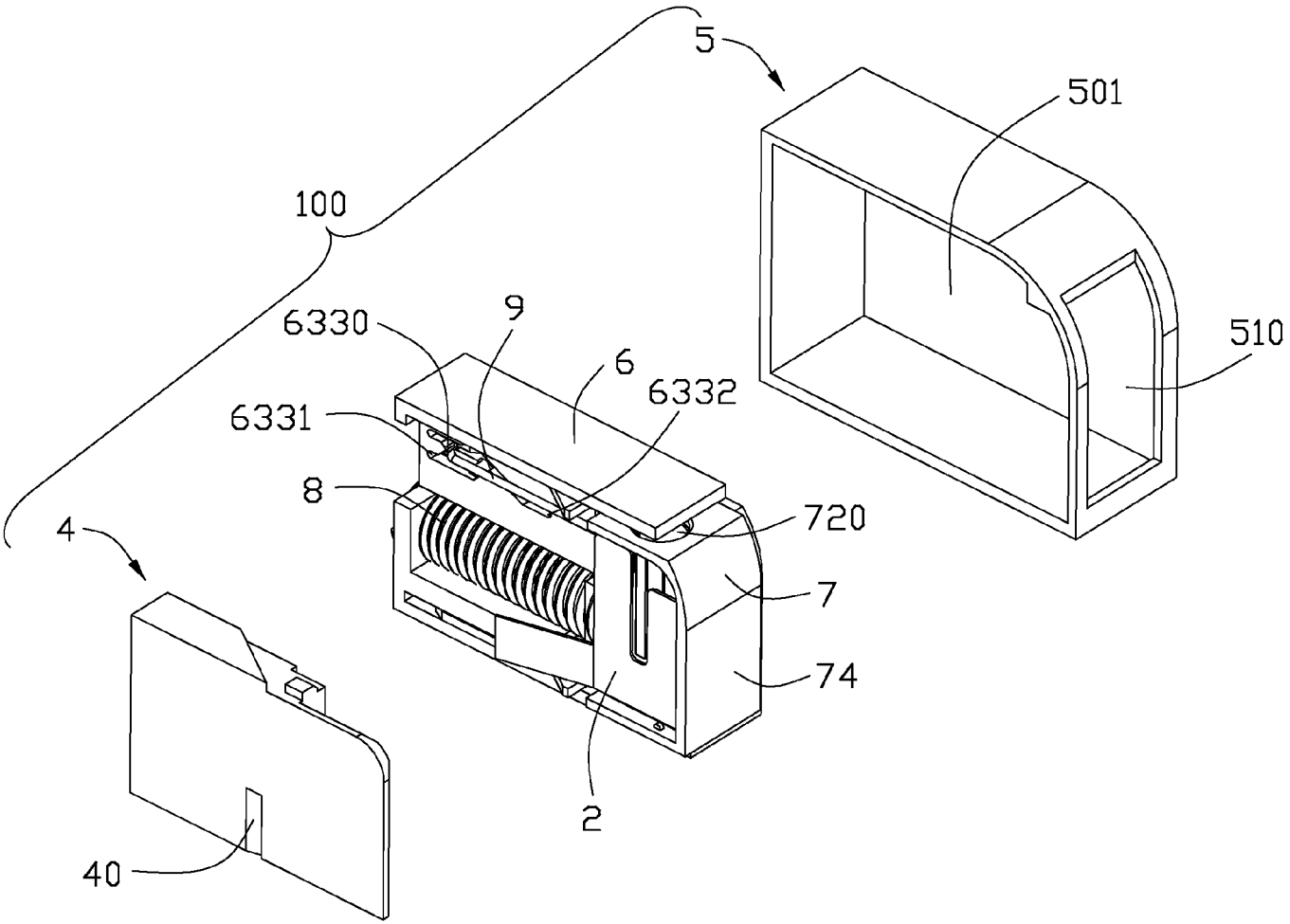
FIG. 5 is perspective, partly exploded view of the electrical connector assembly.

Referring to FIGS. 2, 3 and 5, the ejection mechanism 3 comprises a cover 4 attached to the movable housing 7. The cover 4 forms a pair of securing portions 41 correspondingly retained in the notches 722 of the movable housing 7 for securing the cover 4. Therefore, the cover 4 is moveable along with the ejection mechanism 3 for maintaining the electrical connector 1 in the second space 70. The cover 4 defines a cutout 40. The printed circuit board 2 is connected with the electrical connector 1 and extends out of the cutout 40 for connecting with the mother board of the electrical device.

Figure 6:
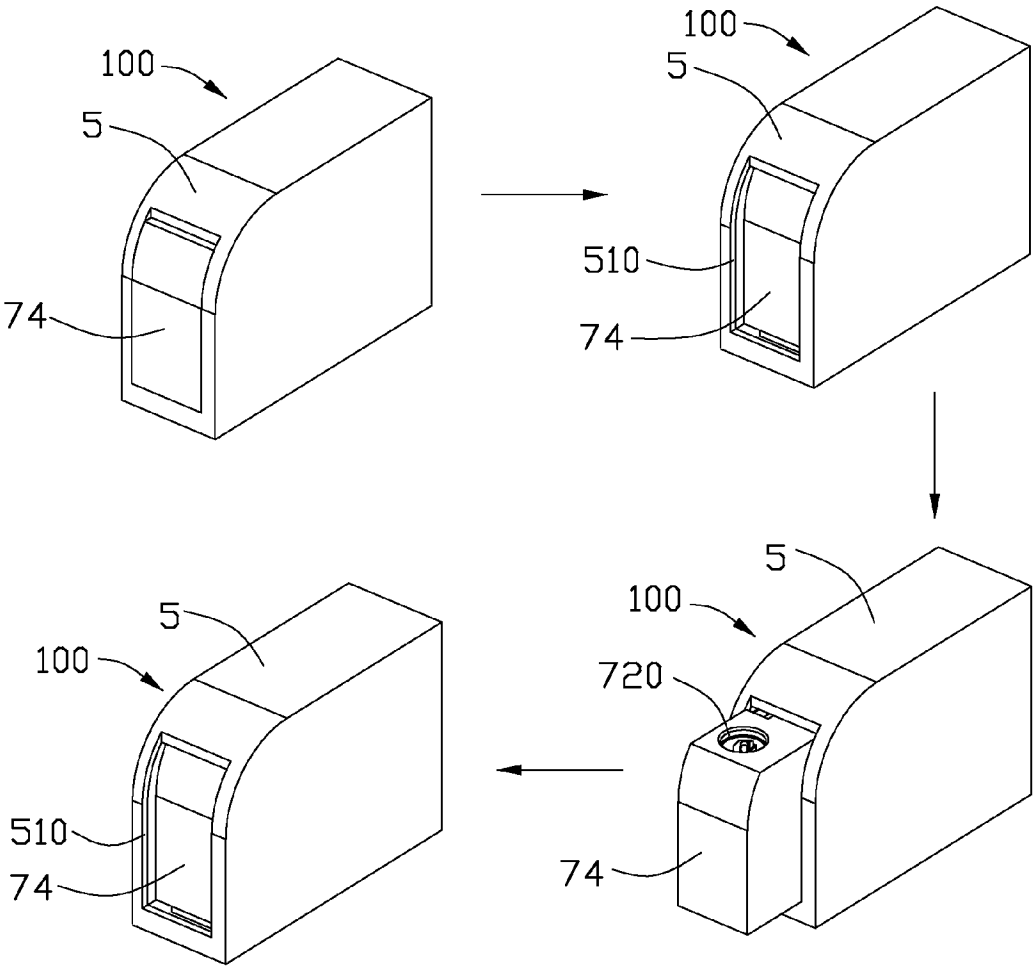
FIG. 6 is a perspective view showing how the electrical connector assembly is used.

Referring to FIG. 2 and FIG. 6, the heart-shaped slot 633 defines a nearest position 6332 with respect to the movable housing 7, a pair of farthest positions 6331 away from the movable housing 7 and a middle position 6330 recessed from the farthest positions 6331 towards the nearest position 6332. When the electrical connector 1 is not in use, the second end 91 of the pin member 9 is located at the middle position 6330 of the heart-shaped slot 633 and the elastic element 8 is compressed. Therefore, the movable housing 7 is close to the immovable housing 6. The front wall 74 of the movable housing 7 keeps planar with the first sidewall 51 of the cage 5, which makes the electrical connector assembly 100 to have a handsome appearance. Furthermore, the electrical connector 1 is hidden in the cage 5, preventing dust or etc from entering into the insertion hole 10 of the electrical connector 1. When the electrical connector 1 is in use, a user slightly pushes the front wall 74 of the movable housing 7 inwardly and the second end 91 of the pin member 9 moves across one of the farthest positions 6331 to be located at the nearest position 6332. Since the second end 91 of the pin member 9 is located at the nearest position 6332 of the heart-shaped slot 633, the elasticity of the elastic element 8 released and the moveable housing 7 moves outwardly through the opening 510 of the cage 5. Therefore, the aperture 720 of the movable housing 7 is aligned with the insertion hole 10 of the electrical connector 1 along an upper-and-down direction perpendicular to the front-and-back direction. The mating connector is capable of being inserted through the aperture 721 into the insertion hole 10 of the electrical connector 1. After the electrical connector 1 has been used, a user pushes the front wall 74 of the movable housing 7 inwardly again, and the second end 91 of the pin member 9 moves across another one of the farthest positions 6331 to be located at the middle portion 6330 once again. The movable housing 7 carrying with the electrical connector 1 is movable out of the cage 5 and retractable in the cage 5 via the ejection mechanism 3. The ejection mechanism 3 is a push-push type.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly for assembling to an electrical device, comprising:

a cage defining a peripheral opening;

an ejection mechanism comprising a first housing held in the cage and a second housing retractably movable relative to the first housing to extend through the opening of the cage, the second housing defining an aperture;

an electrical connector received in the second housing and movable along with the second housing, the electrical connector having an insertion hole aligned with the aperture through which a mating connector is inserted;

a cover attached on the second housing and defining a cutout; and a flexible circuit board connected with the electrical connector and extending through the cutout.

2. The electrical connector assembly as claimed in claim 1, wherein the ejection mechanism is of a push-push type.

3. The electrical connector assembly as claimed in claim 1, wherein the first housing has a bottom wall and defines at least one slit on the bottom wall, and the second housing forms at least one protrusion correspondingly received in the at least one slit and moveable in the at least one slit.

4. The electrical connector assembly as claimed in claim 1, wherein each of the first housing and the second housing forms a bar portion and the elastic element is oriented by the two bar portions.

5. The electrical connector assembly as claimed in claim 1, wherein the ejection mechanism comprises a cover attached to the second housing.

6. The electrical connector assembly as claimed in claim 1, wherein the ejection mechanism comprises an elastic element positioned between the first housing and the second housing.

7. The electrical connector assembly as claimed in claim 6, wherein the ejection mechanism comprises a pin member having a first end retained in one of the first housing and the second housing and a second end guided by the other one of the first housing and the second housing.

8. The electrical connector assembly as claimed in claim 1, wherein the first housing comprises an upper wall, a lower wall, a block portion, and a barrier portion and defines two elongated grooves respectively between the upper wall and the barrier portion and between the lower wall and the block portion, and the second housing has a pair of wing portions received in the elongated grooves and guidably moving in the grooves.

9. The electrical connector assembly as claimed in claim 8, wherein the block portion defines a heart-shaped slot and the second end of the pin member is guided in the heart-shaped slot.

10. The electrical connector assembly as claimed in claim 9, wherein the second housing defines a hole retaining the first end of the pin member.

11. An electrical connector assembly comprising:

a cage defining a receiving space communiating with an exterior via an opening in a first face;

an electrical connector unit disposed in the receiving and back and forth moveable in a first direction between inner and outer positions in an in-and-out manner via said opening, said connector unit defining a mating port extending in a second direction perpendicular to said first direction under condition that the mating port is hidden within the cage from the exterior when the connector unit is located in the inner position while is exposed to the exterior when the connector unit is located in the outer position; and an ejection mechanism arranged between the connector unit and the cage and including a spring to urge the connector unit to move in the first direction, and a guiding path to determine a position of said connector unit between said inner and outer positions.

12. The electrical connector assembly as claimed in claim 11, wherein the opening is essentially blocked when the connector is in an inner position.

13. The electrical connector assembly as claimed in claim 11, wherein said guiding path defines a heart-shaped structure to cooperate with a pin linked to the connector.

14. The electrical connector assembly as claimed in claim 11, wherein said connector unit includes a moveable housing in which an electrical connector is received.

15. The electrical connector assembly as claimed in claim 11, wherein the connector unit is equipped with an FPC (Flexible Printed Circuit) back and forth moveable in the first direction to communicate with the exterior.

16. The electrical connector assembly as claimed in claim 15, wherein said cage defines a second face perpendicular to the first face, around which said FPC extends to communicate with the exterior.

17. The electrical connector assembly as claimed in claim 16, wherein the mating port is directed to a third face of the cage, which is perpendicular to both said first face and said second face, when said connector is located in the outer position.

18. An electrical connector assembly comprising:

a cage defining a receiving space surrounded by a plurality of faces to communiating with an exterior via an opening in a first face;

an electrical connector unit disposed in the receiving and back and forth moveable in a first direction between inner and outer positions in an in-and-out manner via said opening, said connector unit defining a mating port under condition that the mating port is hidden within the cage from the exterior when the connector unit is located in the inner position while is exposed to the exterior when the connector unit is located in the outer position;

an ejection mechanism arranged between the connector unit and the cage and including a spring to urge the connector unit to move in the first direction, and a guiding path to determine a position of said connector unit between said inner and outer positions; and the connector unit being equipped with an FPC (Flexible Printed Circuit) which extends through a second face of the cage perpendicular to said first face.

19. The electrical connector assembly as claimed in claim 18, wherein the connector unit includes a housing defining a slot through which the FPC extends.

20. The electrical connector assembly as claimed in claim 18, wherein the mating port is directed to a third face of the cage, perpendicular to both said first face and said second face.

* * * * *